US005388638A

United States Patent [19]

Gentry

[11] Patent Number: 5,388,638

[45] Date of Patent: Feb. 14, 1995

[54] ROD BAFFLE HEAT EXCHANGER

[75] Inventor: Cecil C. Gentry, Bartlesville, Okla.

[73] Assignee: Phillips Petroleum Company, Bartlesville, Okla.

[21] Appl. No.: 174,493

[22] Filed: Dec. 28, 1993

[51] Int. Cl.[6] ..... F28F 9/00

[52] U.S. Cl. ..... 165/162; 165/69; 122/510

[58] Field of Search ..... 165/162, 69; 122/510

[56] References Cited

U.S. PATENT DOCUMENTS

| | | | |
|---|---|---|---|
| 3,837,397 | 9/1974 | Pettigrew | 165/162 |
| 3,941,188 | 3/1976 | Scheidl | 165/162 |
| 3,964,146 | 6/1976 | Vestre et al. | 165/162 X |
| 3,967,677 | 7/1976 | Mohlman | 165/162 |
| 4,013,121 | 3/1977 | Berger et al. | 165/162 |
| 4,286,366 | 9/1981 | Vinyard | 165/162 X |
| 4,398,595 | 8/1983 | Small | 165/109 R |
| 4,718,479 | 1/1988 | Lagally et al. | 165/69 |
| 4,784,220 | 11/1988 | Engel | 165/162 |
| 4,793,406 | 12/1988 | Becker | 165/162 |
| 5,005,637 | 4/1991 | Gentry | 165/69 |
| 5,127,469 | 7/1992 | Boula | 165/69 |
| 5,139,084 | 8/1982 | Gentry | 165/162 |

OTHER PUBLICATIONS

R. Perry and C. Chilton eds., *Chemical Engineers' Handbook*, McGraw-Hill, 5th ed., 1973, pp. 11-14.

C. G. Gentry, RODbaffle Heat Exchanger Technology, Chemical Engineering Progress, 86 (7), p. 54 (1990).

*Primary Examiner*—Martin P. Schwadron
*Assistant Examiner*—L. R. Leo
*Attorney, Agent, or Firm*—Ryan N. Cross

[57] ABSTRACT

An improved rod baffle heat exchanger and method for manufacturing the same are disclosed in which cross-support members are used to prevent support rod movement and to provide increased rigidity in the heat exchanger. The cross-support members have a threaded circular section at each end, to which threaded nuts are attached. The threaded nuts rest on a protective pad, which is adjacent to the outermost tubes. As the nuts are tightened at each end of the threaded cross-support member, the baffle support rods are brought into firm contact with adjacent tubes.

7 Claims, 7 Drawing Sheets

ROD BAFFLE HEAT EXCHANGER

BACKGROUND OF THE INVENTION

The present invention relates generally to heat exchangers, and more particularly, but not by way of limitation, to rod baffle heat exchangers.

Various rod baffle heat exchangers have been disclosed in the art. Several of these heat exchangers have been put into successful, practical application. With large rod baffle heat exchangers, it may be necessary to provide additional support to the baffle rods to prevent sagging of the baffle rods. This is accomplished using cross-support rods installed in the rod baffle perpendicular to the baffle rods. Another problem in large rod baffle heat exchangers is to establish a firm contact between the rods and the heat exchanger tubes while avoiding rod-to-tube tolerance build-up problems. One proposal to solve this problem was to provide rods with areas of varying cross-sections and slide the rod so that an area of the rod having a small cross-section is replaced by an area of a rod having a larger cross-section between the tubes, whereby the area of the rod with a larger cross-section is urged into firm contact with the tubes. Another proposal to solve this problem was to use rods having elliptical cross-sections; therefore, allowing easy assembly and firm engagement of the rods and tubes by simple rotation of the rods about their longitudinal axis. Another proposal is to use baffle rods which comprise circular standard rods and circular substitute rods wherein the diameter of the substitute rods differs from that of the standard rods.

SUMMARY OF THE INVENTION

It is one object of this invention to provide a rod baffle useful for heat exchangers with at least one cross-support rod that will allow firm contact between the rods and the tubes while avoiding positive tolerance build-up between rods and tubes.

Another object of this invention is to provide a heat exchanger incorporating such rod baffles.

A further object of this invention is to provide an improved method for manufacturing heat exchangers.

In accordance with this invention, there is provided a rod baffle having at least one cross-support rod with a threaded first end and threaded second end with a first nut threaded onto the first end of the cross-support rod and a second nut threaded onto the second end of the cross-support rod so that the first nut and the second nut can be tightened onto the cross-support rod in order to apply inward pressure to the tubes of the tube bundle.

In accordance with another aspect of this invention, a process is provided for producing heat exchangers wherein rod baffles are used having at least one cross-support rod having a threaded first end and a threaded second end and a first nut threaded onto the first end and a second nut threaded onto the second end so that the first nut and the second nut can be tightened onto the cross-support rod in order to apply inward pressure to the tubes of the tube bundle.

BRIEF DESCRIPTION OF THE DRAWINGS

FIG. 3 is an enlarged partial cross-sectional view more clearly illustrating the top portion of the cross-support member employed in the embodiment of FIG. 3.

DETAILED DESCRIPTION OF THE INVENTION

Figure 1:
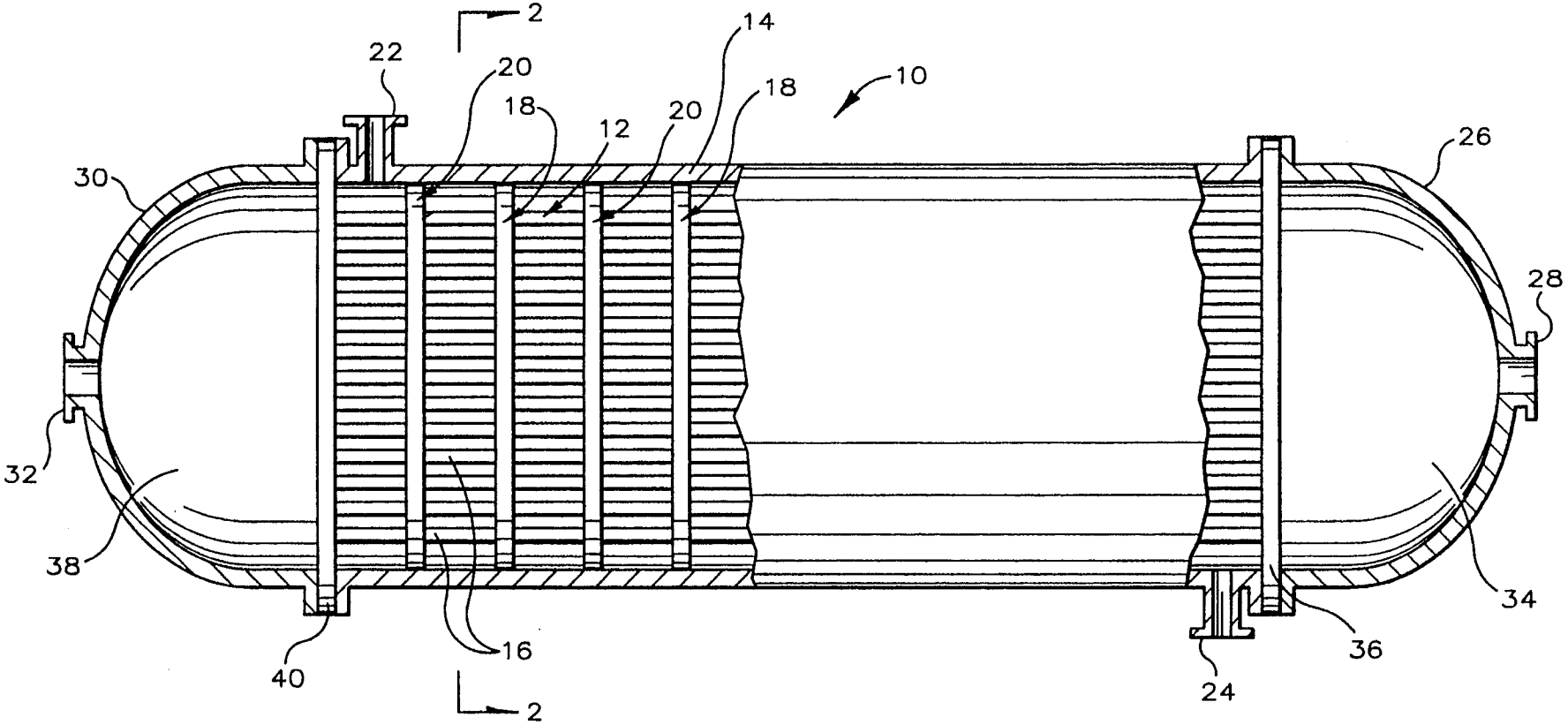
FIG. 1 is a side elevation view of a shell-and-tube heat exchanger constructed in accordance with the invention with the portions of the shell broken away to more clearly illustrate the internal structure.

Referring now to the drawings, and to FIG. 1 in particular, there is illustrated a shell-and-tube heat exchanger 10. A rod baffle tube bundle 12 is surrounded by shell 14. The tube bundle 12 comprises a plurality of tubes 16 supported by a plurality of horizontal rod baffle assemblies 18 and vertical rod baffle assemblies 20. One fluid enters the fluid side of the shell-and-tube heat exchanger 10 through an inlet 22 and after heat exchange with the fluid in the tubes 16, leaves the shell side via outlet 24. The fluid flowing through the tube side of the heat exchanger 10 enters the endcap 26 of the heat exchanger 10 via inlet 28 and leaves the endcap 30 of the heat exchanger 10 via outlet 32. This fluid flows from end chamber 34, which is defined by the endcap 26 of the heat exchanger and the tube sheet 36, through the tubes 16 and into the opposite end chamber 38, which is similarly defined by the endcap 30 and the other tube sheet 40.

Figure 2:
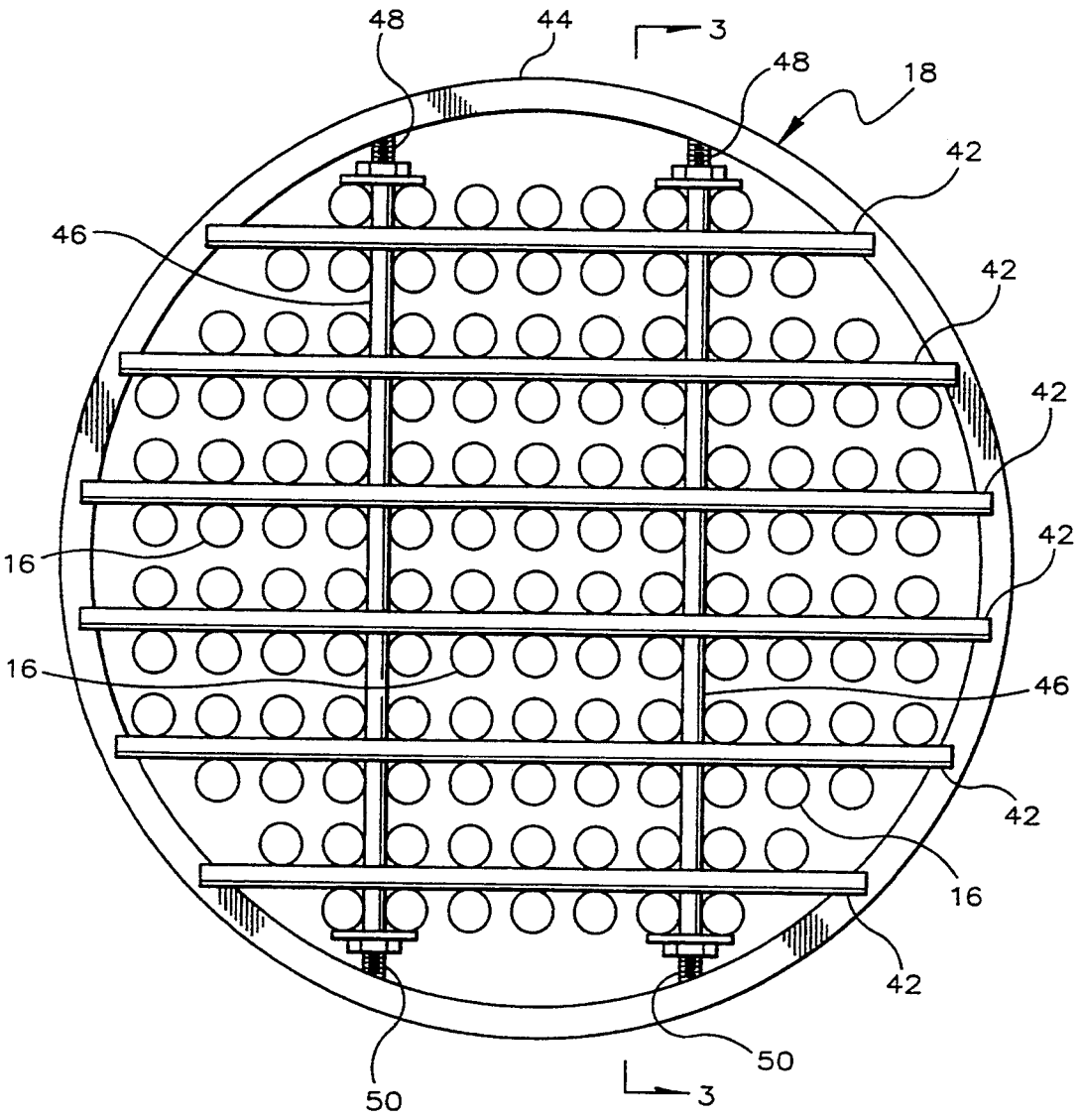
FIG. 2 is a cross-sectional view taken along line 2—2 of FIG. 1.

The tubes 16 can be arranged in a square pattern as shown in FIG. 2. The tubes 16 are kept in position by a plurality of horizontal rod baffle assemblies 18 and vertical rod baffle assemblies 20. The horizontal rod baffle assembly 18 shown in FIG. 2 is a part of a 4-baffle set. A 4-baffle set is a baffle set which comprises two horizontal rod baffles and two vertical rod baffles so that the four baffles together provide radial support on four sides of each tube 16. One type of 4-baffle set is described in U.S. Pat. No. 5,139,084, the disclosure of which is hereby incorporated by reference.

While the 4-baffle set is presently preferred, it is emphasized that a supporting apparatus in accordance with the present invention only requires that the rods in each baffle assembly inserted in the spaces between adjacent tube rows in one plurality of tube rows are inserted into less than the total number of such spaces. It is immaterial whether the rods are inserted in adjacent spaces, alternate spaces, two adjacent spaces followed by skipping two spaces or any variation desired.

The minimum number of rods in a baffle assembly is the number sufficient for the baffle set to provide radial support for each tube forming the tube bundle. It is preferred that this functional limitation also be used to determine the maximum number of rods in a baffle assembly because the pressure drop across the shell side of a shell-and-tube heat exchanger is the lowest when the least number of rods are used to form the baffle assemblies; however, it is essential to use enough rods in each baffle assembly for the baffle set to provide radial support for each tube. The number of baffle assemblies constituting a baffle set as described above must not be confused with the total number of baffle assemblies used in the tube bundle as this latter number can be any number above the minimum number required in a baffle set and the total number of baffle assemblies in the tube bundle is otherwise independent of the number of baffle assemblies in a baffle set.

It is apparent that the minimum number of baffle assemblies per baffle set is dependent upon the tube layout. While FIG. 2 shows a square pitch tube layout, other tube layouts are possible in which the minimum number of baffle assemblies in a baffle set may be other than those specifically discussed. With any tube layout, at least two baffle assemblies per baffle set are required to practice the present invention and the specific tube layouts herein discussed are presented for the purpose of illustration and are not intended to limit the broad invention.

Figure 3:
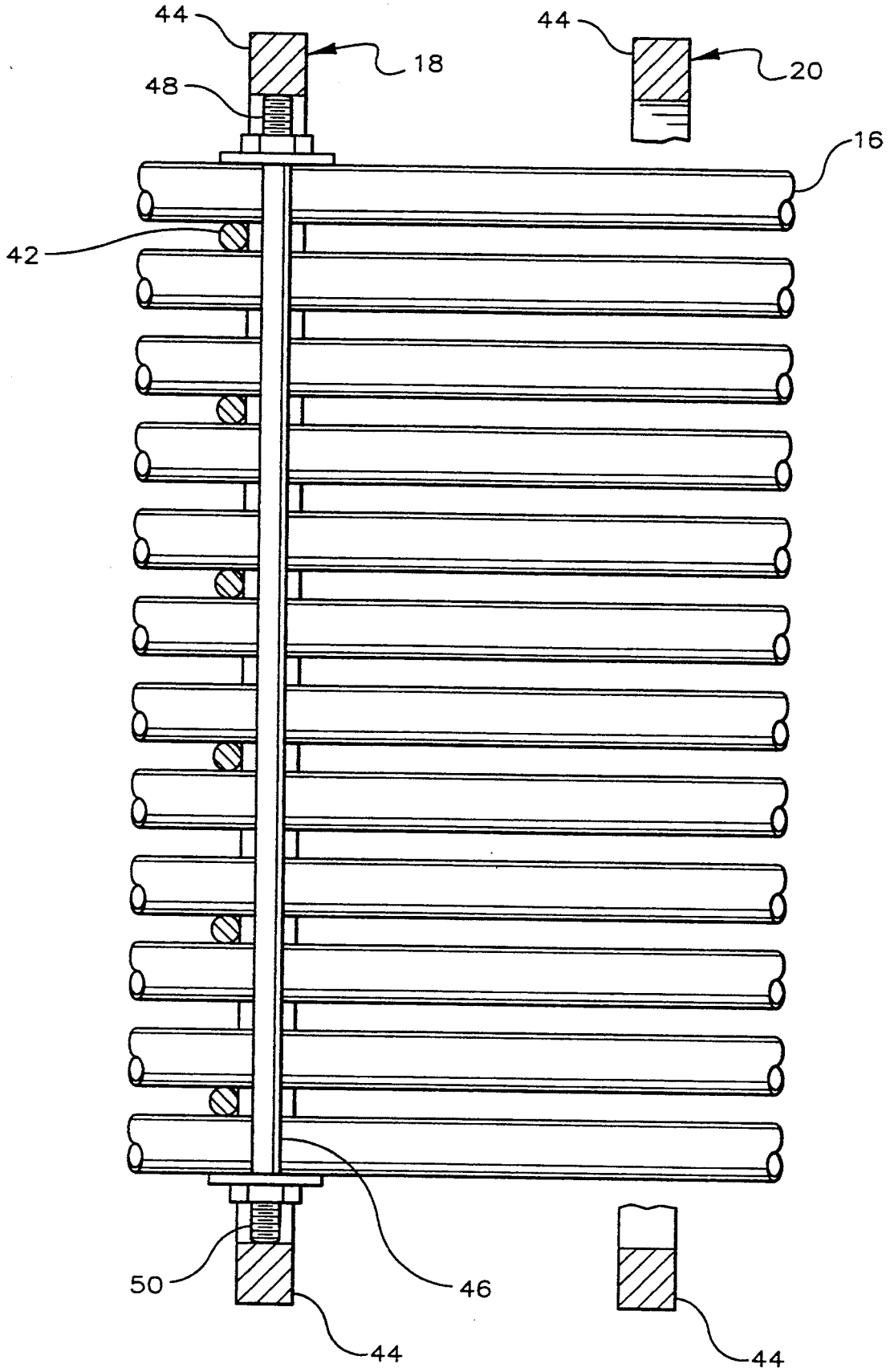
FIG. 3 is a cross-sectional view taken along line 3—3 of FIG. 2.

The construction of the rod baffle assembly 18 is more clearly illustrated in FIGS. 2 and 3. The horizontal rod baffle assembly 18 comprises a plurality of horizontally extending support rods 42 that are fixedly secured at their opposite ends to the baffle ring 44 and are evenly spaced so that they extend between alternate pairs of the horizontal, parallel rows of tubes 16. At least one cross-support rod 46 having a threaded first end 48 and a threaded second end 50 is fixedly secured to the baffle ring 44 and its first end 48 and its second end 50 in perpendicular relation to the support rods 42. Although FIG. 2 shows two cross-support rods 46, the number of cross-support rods 46 may vary depending upon the size of the rod baffle assembly 18. Preferably, they will be in the range of from 1 to about 8 cross-support rods 46.

Threaded first end 48 and threaded second end 50 may be fixedly secured by any suitable method. Ends 48 and 50 may be fixedly secured to the baffle ring 44 by means such as welding ends 48 and 50 to the inside surface of baffle ring 44 or by inserting cross-support rod 48 through holes in baffle ring 44 such that a portion of threaded first end 48 and a portion of threaded second end 50 lie within the hole when they are positioned.

Figure 4:
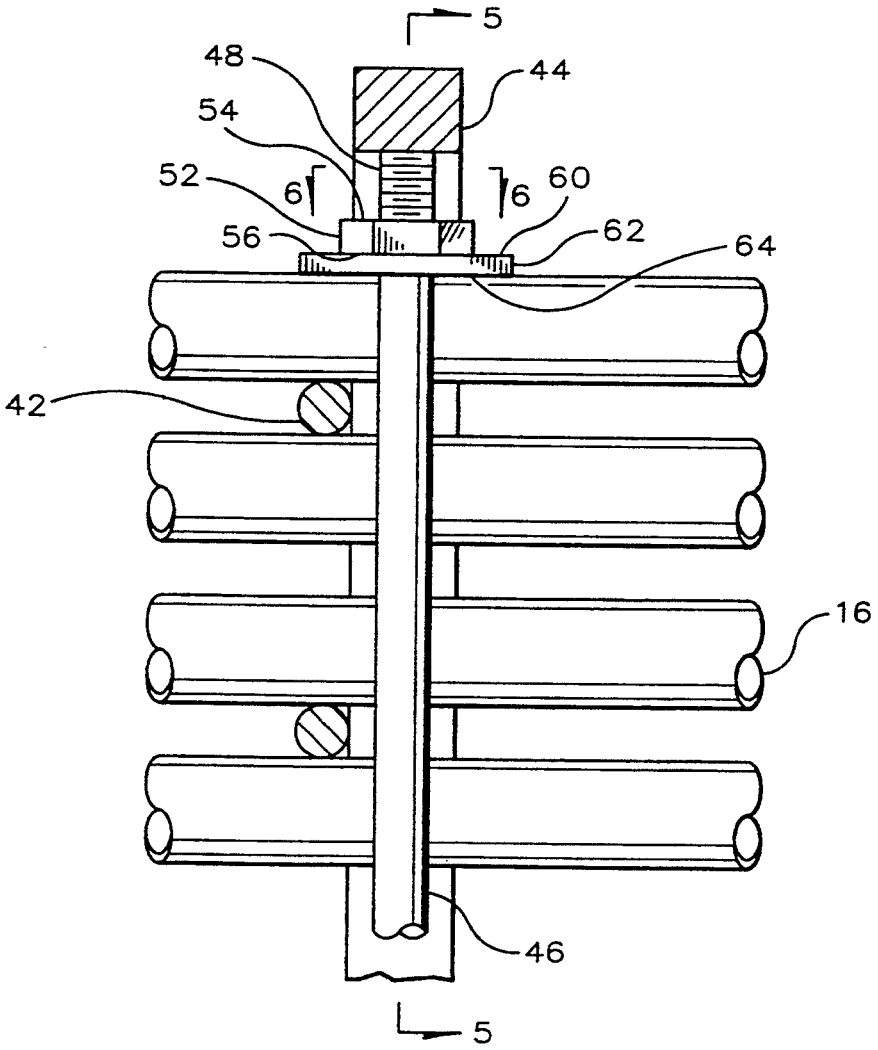
FIG. 4 is an enlarged partial cross-sectional view more clearly illustrating the upper portion of the cross-support rod employed in the embodiment of FIG. 3.
Figure 5:
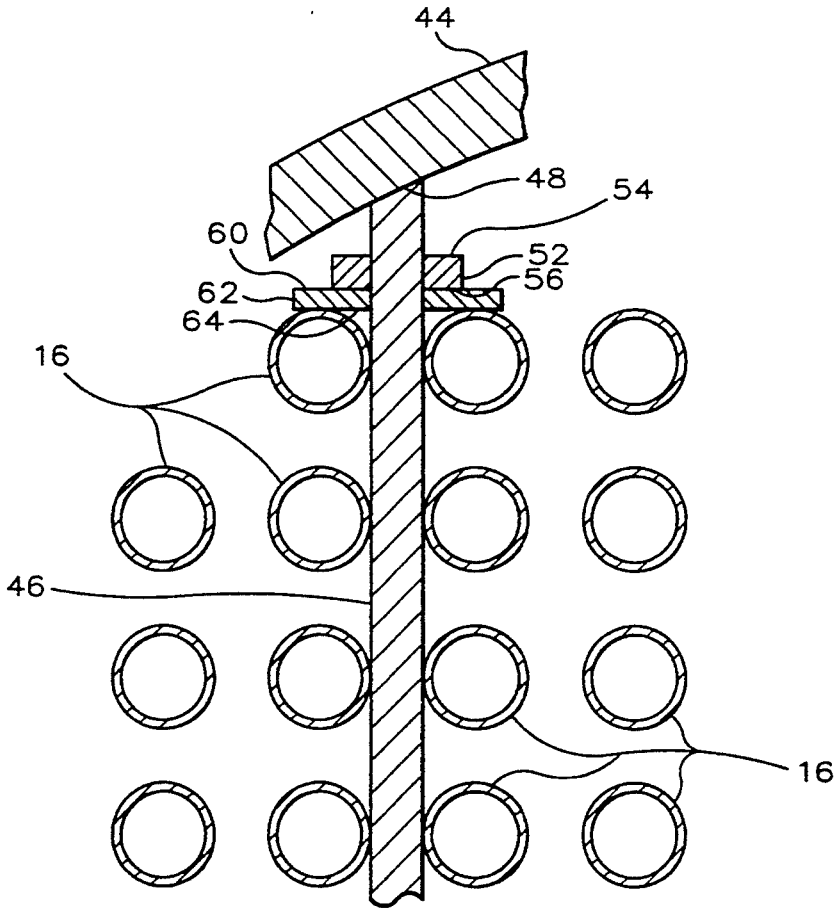
FIG. 5 is a cross-sectional view taken along line 5—5 of FIG. 4.
Figure 6:
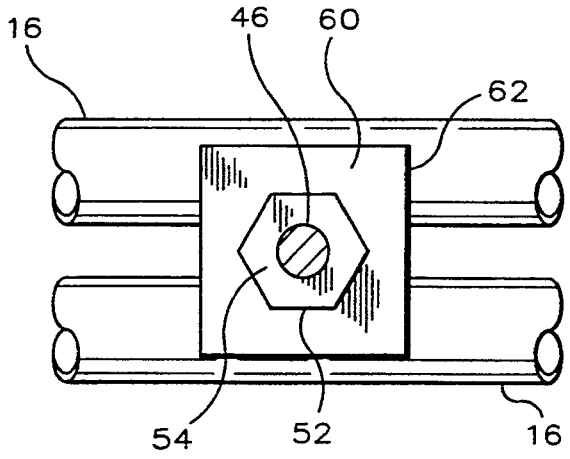
FIG. 6 is a cross-sectional view taken along line 6—6 of FIG. 4.

The upper portion of the cross-support rod can be more clearly seen in FIGS. 4, 5 and 6. Threaded first end 48 of cross-support rod 46 is fixedly secured to the baffle ring 44. First nut 52 is mounted on cross-support rod 46. First nut 52 comprises a perforated block of metal that has an internal screw thread and is mounted upon cross-support 46 by engaging the internal screw threads of first nut 52 with the threads of first threaded end 48 in such a way that by turning the first nut 52 in one direction will result in first nut 52 moving towards second threaded end 50 and by turning first nut 52 in the opposite direction will result in first nut 52 moving away from second threaded end 50. For convenience, turning first nut 52 so that it moves towards second threaded end 50 will be referred to as turning first nut 52 clockwise and turning it so that it moves away from second threaded end 50 will be referred to as turning first nut 52 counter-clockwise. First nut 52 has first face 54 and second face 56. As first nut 52 is turned clockwise, second face 56 contacts and applies pressure to the first face 60 of first support pad 62. In turn, the second face 64 comes in contact with and applies pressure to tubes 16.

Figure 7:
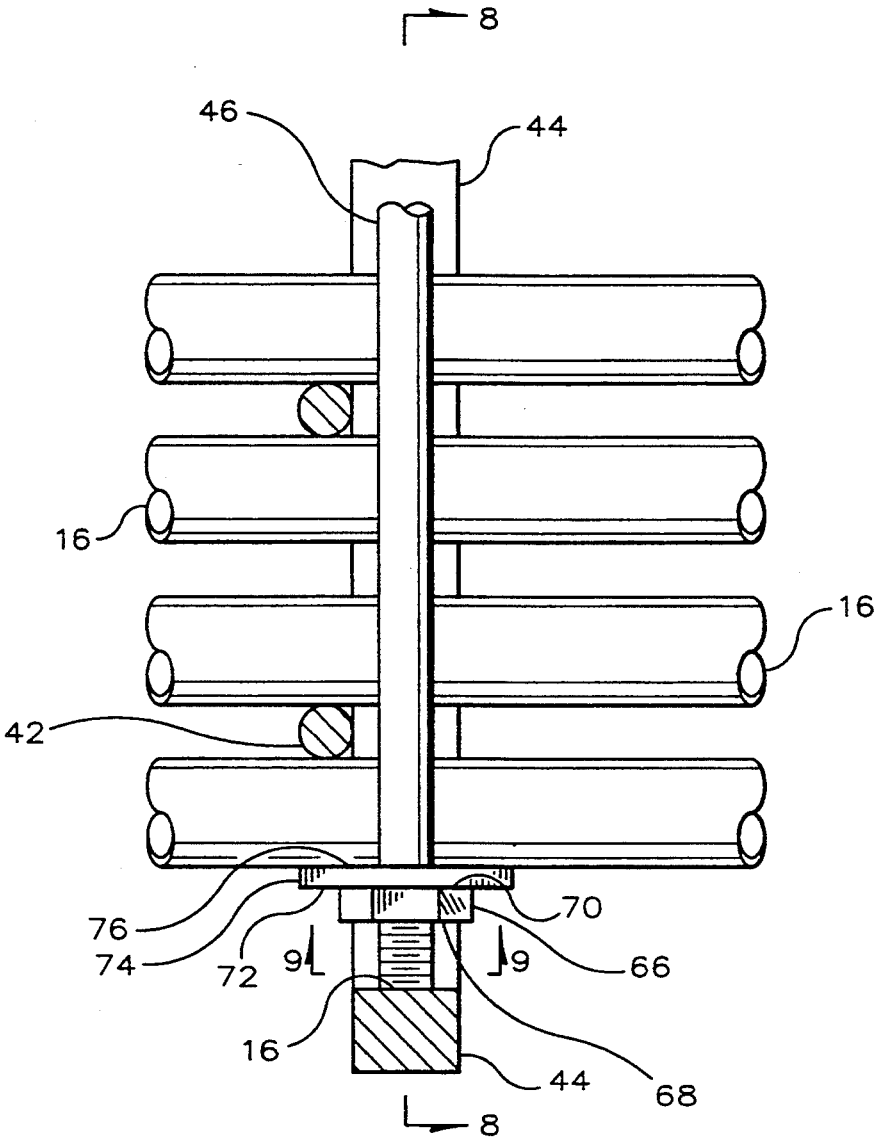
FIG. 7 is an enlarged partial cross-sectional view more clearly illustrating the lower portion of the cross-support rod employed in the embodiment of FIG. 3.
Figure 8:
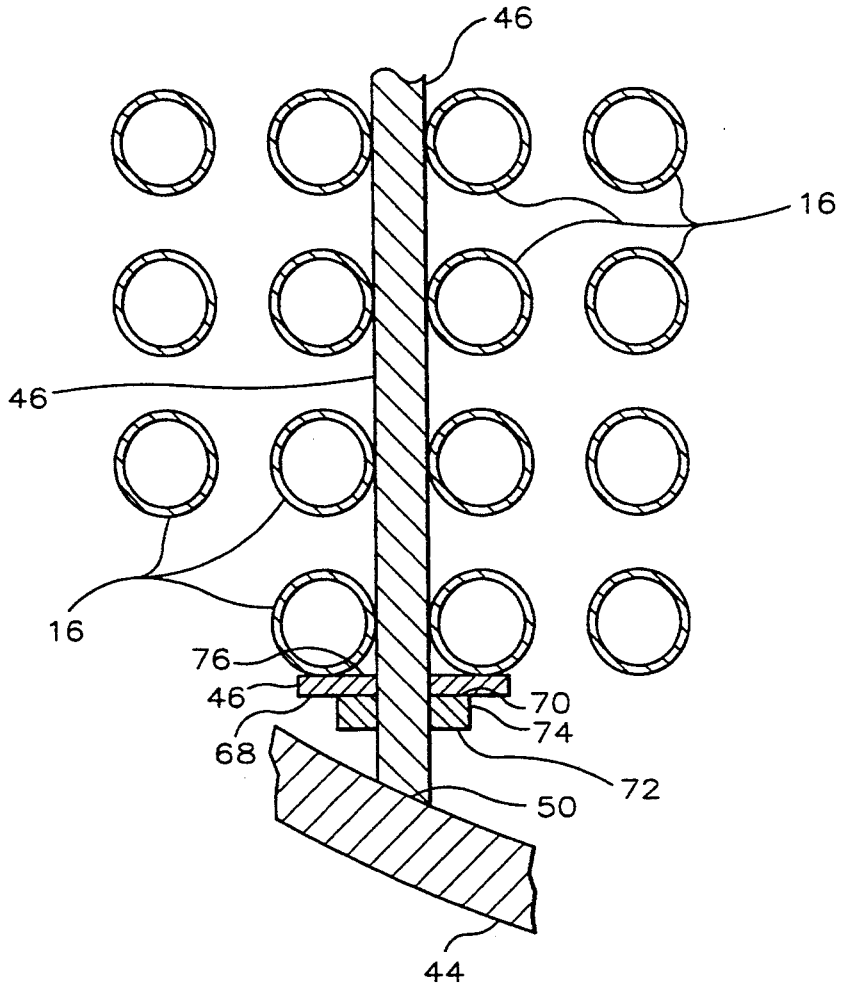
FIG. 8 is a cross-sectional view taken along line 8—8 of FIG. 7.
Figure 9:
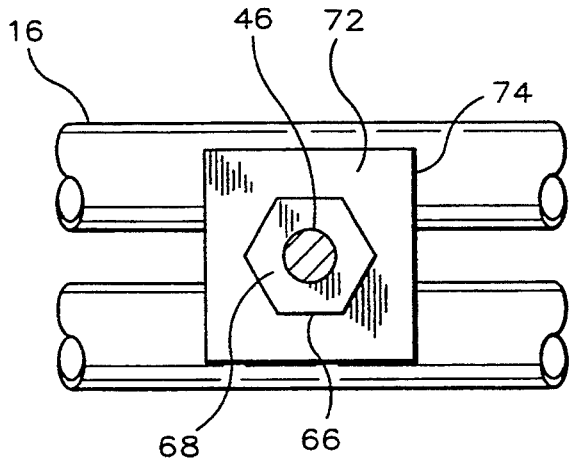
FIG. 9 is a cross-sectional view taken along line 9—9 of FIG. 7.

Similarly, as can be more clearly seen from FIGS. 7, 8 and 9, second threaded end 50 of cross-support rod 46 is fixedly attached to baffle ring 44 and has mounted thereon second nut 66 in the same manner as first nut 52 is mounted upon first threaded end 48. Thus, when second nut 66 is turned in one direction, it will move towards first threaded end 48 and when it is turned in the opposite direction, it will move away from first threaded end 48. For convenience, turning second nut 66 so that it moves towards first threaded end 48 will be referred to as turning second nut 66 clockwise and turning it so that it moves away from first threaded end 48 will be referred to as turning second nut 66 counter-clockwise. Second nut 66 has first face 68 and second face 70. As second nut 66 is turned clockwise, second face 70 of second nut 66 contacts and applied pressure on the first face 72 of second support pad 74 and the second face 76 of second support pad 74 accordingly contacts and applies pressure to tubes 16. First support pad 62 and second support pad 74 have a circular cross-sectional passageway running through them such that they can be mounted upon cross-support rod 46 by placing rod 46 through the passageway.

In the preferred method of fabricating the invention, the horizontal rod baffle assembly 18 and vertical rod baffle assemblies 20 are constructed with support rods 42 fixedly secured to the baffle rings. The first support pad 68 and second support pad 74 are mounted upon the cross-support 46 rods and then the first nut 52 and second nut 66 are mounted upon the cross-support rod 46 by screwing the nuts onto the first threaded 48 end and second threaded end 50, respectively. Next, the cross-support rods are fixedly secured to the baffle rings 44 such that the cross-support rods 46 are substantially perpendicular to the support rods 42. After the baffle assemblies 18 and 20 have been prepared, a plurality of tubes 16 are inserted through each of the baffle assemblies 18 and 20 which are spaced apart as illustrated in FIG. 1. At this point the tubes 16 are supported by the support rods 42 of baffle assemblies 18 and 20 with the tubes spaced in mutually parallel relation with a common axis of alignment. The common axis of alignment of the tubes is substantially perpendicular to the common axis of alignment of the support rods. Each of the tubes are positioned adjacent one of the support rods.

When the tubes are in place, the first nut 52 and second nut 66 are rotated clockwise so as to provide an inward pressure on the tubes. The inward pressure should be sufficient to eliminate the positive tolerance between the tubes and the support rods. By using the inward pressure created by the first and second nut, the rigidity of the tubes can be increased without the necessity of welding the support rods to the cross-support rods.

The ends of the tubes 16 are then received through the corresponding apertures formed in the tube sheets 36 and 40. When suitably positioned, the tubes 16 are fixedly secured to the tube sheets 36 and 40 with each tube forming a tight seal with the corresponding aperture in each tube sheet.

Alternatively, the first end of each tube 16 can be fixedly secured to the tube sheet 36 before insertion of the tubes 16 through the baffle assemblies with such first end of each tube 16 forming a fluid tight seal with the corresponding aperture in the tube sheet 36. After insertion of the tubes 16 through the baffle assemblies, first nut 52 and second nut 66 are rotated clockwise so as to provide an inward pressure on the tubes. The second ends of each tube 16 are fixedly secured to the tube sheet 40 with the second ends of each tube 16 forming a fluid tight seal with the corresponding aperture in the tube sheet 46.

The tube bundle 12 thus assembled is inserted into the open end of the shell 74 and properly positioned therein at which time the open ends of shell 14 are closed by suitable end caps 26 and 30.

Reasonable variations and modifications which will be apparent to those skilled in the art can be made in this invention without parting from the spirit and scope thereof.

That which is claimed is:

1. A rod baffle comprising:

an outer ring;

a plurality of support rods each having first and second ends wherein each said support rod is fixedly secured at its first and second end to said outer ring so that said outer ring has a plurality of said support rods secured thereto in parallel equally spaced relation;

at least one cross-support rod having a first end and a second end wherein said cross-support rod is fixedly secured at its first and second end to said outer ring in perpendicular relation to said support rods and wherein a portion of said cross-support rod is provided with a screw thread in close proximity to said first end of said cross-support rod and wherein a portion of said cross-support rod is provided with a screw thread in close proximity to said second end of said cross-support rod;

a first nut for applying inward pressure wherein said first nut is threaded to said cross-support rod in close proximity to said first end of said cross-support rod and is located within said ring; and a second nut for applying inward pressure wherein said second nut is threaded to said cross-support rod in close proximity to said second end of said cross-support rod and is located within said ring.

2. The rod baffle of claim 1 further comprising:

a first support pad having a first face and a second face and a passageway extending through the center of said first support pad from said first face to said second face of said first support pad wherein said cross-support rod extends through said passageway so that said first support pad is positioned between said first nut and said second end of said cross-support rod; and a second support pad having a first face and a second face and a passageway extending through the center of said second support pad from said first face to said second face of said second support pad wherein said rod extends through said passageway so that said second support pad is positioned between said second nut and said first support pad.

3. An improved cross-support rod for use in the baffle of a rod baffle heat exchanger comprising a rod having a first end and a second end wherein said rod is provided with a first screw thread extending from said first end of said rod to a point between said first and second end of said rod and having a second screw thread extending from said second end of said rod to a point between said first and second end of said rod and wherein a first nut located within said ring for applying inward pressure is secured to said rod in close proximity to said first end of said rod by means of being threaded onto said first screw thread and wherein a second nut located within said ring for applying inward pressure is secured to said rod in close proximity to said second end of said rod by means of being threaded onto said second screw thread.

4. The improved cross-support rod of claim 3 further comprising:

a first support pad having a first face and a second face and a passageway extending through the center of said first support pad from said first face to said second face of said first support pad wherein said rod extends through said passageway so that said first support pad is positioned between said first nut and said second end of said rod; and a second support pad having a first face and a second face and a passageway extending through the center of said second support pad from said first face to said second face of said second support pad wherein said rod extends through said passageway so that said second support pad is positioned between said second nut and said first support pad.

5. An improved tube bundle for use in a rod baffle heat exchanger comprising:

a plurality of parallel tubes with a common axis of alignment arranged to form a plurality of parallel rows of tubes;

at least one outer ring surrounding said plurality of tubes in a plane about normal to the common axis of alignment to said plurality of tubes;

a plurality of support rods having first and second ends wherein each said support rod is fixedly secured at its first and second end to said outer ring so that said outer ring has a plurality of said support rods secured thereto in parallel equally spaced relation and wherein each of said tubes is adjacent one of said support rods;

at least one cross-support rod having a first end and a second end wherein said cross-support rod is fixedly secured at its first and second end to said outer ring in perpendicular relation to said support rods and wherein a portion of said cross-support rod is provided with a screw thread in close proximity to said first end of said cross-support rod and wherein a portion of said cross-support rod is provided with a screw thread in close proximity to said second end of said cross-support rod;

a first nut threaded to said cross-support rod in close proximity to said first end of said cross-support rod such that said first nut is adjacent to and provides pressure on at least one of said tubes; and a second nut threaded to said cross-support rod in close proximity to said second end of said cross-support rod such that said second nut is adjacent to and provides pressure on at least one of said tubes.

6. A tube bundle in accordance with claim 5, further comprising:

a first support pad having a first face and a second face and a passageway extending through the center of said first support pad from said first face to said second face of said first support pad wherein said cross-support rod extends through said passageway so that said first support pad is positioned between said first nut and said at least one tube to which said first nut is adjacent; and a second support pad having a first face and a second face and a passageway extending through the center of said second support pad from said first face to said second face of said second support pad wherein said cross-support rod extends through said passageway so that said second support pad is positioned between said second nut and said at least one tube to which said second nut is adjacent.

7. A method for manufacturing a tube bundle comprising at least a first aperture tube sheet, second aperture tube sheet, a plurality of parallel tubes each having a first end and a second end, at least one outer ring, a plurality of support rods supportable by each ring in spaced mutual parallel relation with a common axis of alignment, and at least one cross-support rod comprising a rod having a first end and a second end wherein said rod is provided with a first screw thread extending from said first end of said rod to a point between said first and second end of said rod and having a second screw thread extending from said second end of said rod to a point between said first and second end of said rod and wherein a first nut is secured to said rod in close proximity to said first end of said rod by means of being threaded onto said first screw thread and wherein a second nut is secured to said rod in close proximity to said second end of said rod by means of being threaded onto said second screw thread wherein said first and second end of each cross-support rod are fixedly secured to said baffle ring so that each said cross-support rod is aligned perpendicular to said axis of alignment of said support rods, comprising the steps of:

inserting a plurality of said tubes through each of said outer rings in spaced mutually parallel relation with a common axis of alignment, the common axis of alignment of said tubes being substantially normal to the common axis of alignment of said support rods, each tube being positioned proximate one of said support rods;

rotating said first nut and said second nut in a clockwise direction so as to provide an inward pressure on said tubes until the positive tolerance between said tubes and said support rods is eliminated; and fixedly securing the first end of each said tube in respective apertures of said first aperture tube sheet and fixedly securing the second end of each said tube in respective apertures of said second aperture tube sheet.

* * * * *